US006701560B2

(12) United States Patent
Foley

(10) Patent No.: US 6,701,560 B2
(45) Date of Patent: Mar. 9, 2004

(54) NAIL PULLING UTILITY TOOL

(76) Inventor: Michael R. Foley, 130 Treasure La., Hailey, ID (US) 83333

( * ) Notice: Subject to any disclaimer, the term of this patent is extended or adjusted under 35 U.S.C. 154(b) by 0 days.

(21) Appl. No.: 10/123,829

(22) Filed: Apr. 15, 2002

(65) Prior Publication Data

US 2003/0192129 A1 Oct. 16, 2003

(51) Int. Cl.[7] ..... B25D 1/04
(52) U.S. Cl. ..... 7/144; 7/125; 254/23
(58) Field of Search ..... 7/143, 144, 125, 7/137; D8/52, 55, 56, 75; 254/23

(56) References Cited

U.S. PATENT DOCUMENTS

| | | | | | |
|---|---|---|---|---|---|
| 600,082 | A | * | 3/1898 | Krutsch | 7/137 |
| 885,816 | A | | 4/1908 | Weyeneth | |
| 929,821 | A | * | 8/1909 | Bonner | 7/137 |
| 1,293,966 | A | | 2/1919 | Springer | |
| 1,382,109 | A | | 6/1921 | Matsler | |
| 1,495,028 | A | | 5/1924 | Mitchell | |
| 1,532,147 | A | | 4/1925 | MacPherson | |
| 1,644,352 | A | | 10/1927 | Perrin | |
| 1,949,335 | A | | 2/1934 | Settles | |
| 2,313,530 | A | | 3/1943 | Feigion | |
| 2,336,961 | A | * | 12/1943 | Russell | 7/137 |
| 2,462,250 | A | | 2/1949 | Andrews | |
| 2,501,500 | A | | 3/1950 | De Armond | |
| 2,578,230 | A | * | 12/1951 | Davis | 7/130 |
| 4,953,248 | A | * | 9/1990 | Trombetta | 7/137 |
| 5,150,488 | A | * | 9/1992 | Yuan et al. | 7/137 |
| D356,238 | S | * | 3/1995 | Moore et al. | D8/52 |
| 5,575,029 | A | * | 11/1996 | Simpson | 7/137 |
| 5,636,398 | A | | 6/1997 | Fike | |
| 6,105,935 | A | * | 8/2000 | Wagner | 254/23 |
| 6,202,517 | B1 | * | 3/2001 | Dolan | 81/427 |
| 6,223,373 | B1 | * | 5/2001 | Yeh | 7/137 |
| 6,314,599 | B1 | * | 11/2001 | Hay | 7/137 |

* cited by examiner

*Primary Examiner*—James G. Smith
(74) *Attorney, Agent, or Firm*—Gene Scott - Patent Law & Venture Group

(57) ABSTRACT

A nail-pulling tool has a two-piece proximal handle pivotally joined with a two-piece distal jaw by a pivoting means. The distal jaw is operated like a standard hand tool with compression of the handle causing the jaw to close, and vice-versa. The distal jaw has an elliptical surface so that with the distal jaw resting on a work surface and closed about a nail protruding from the work surface, and with the handle laying adjacent the work surface, raising the handle away from the work surface in an arc, causes the nail to be pulled from the work surface at an ever increasing rate. Axially oriented jaw teeth provide improved gripping and a pair of tongue and groove opposing surfaces enable cutting and further improved gripping. A hammer surface enables driving of a nail into the work surface rather than pulling it out, and a claw element enables pulling a nail head up so as to be better gripped by the tool. The tool is ideally designed for pulling a bent nail partially upward, straightening it, and then hammering it back into the surface in a more correct and improved manner for accomplishing its fastening task.

5 Claims, 2 Drawing Sheets

NAIL PULLING UTILITY TOOL

BACKGROUND OF THE INVENTION

1. Field of the Invention

This invention relates generally to hand tools especially nail pulling tools, and more particularly to a nail pulling tool with distal and proximal jaws and an elliptical jaw surface.

2. Description of Related Art

The following art defines the present state of this field:

Weyeneth, U.S. Pat. No. 885,816 describes a tool comprising two pivotally connected handles each provided with a jaw having a flat meeting face, each of said faces formed with two longitudinally disposed V-shaped grooves connected to a transverse groove at the rear of the same, the grooves in each jaw adapted to register when the jaws are closed, and a transverse rib projecting from the face of one of said jaws adjacent the transverse groove therein adapted to project inwardly of the face of the other jaw when said faces are brought together.

Springer, U.S. Pat. No. 1,293,066 describes a tool of the character set forth, comprising pivotally connected members having handle shanks and projecting work-engaging elements, and a cutting blade carried by one member, the other member having a channel to receive the blade when the handle shanks are together, said blade thereby including a cutter when the handle shanks are separated and relatively moved toward each other and also constituting a holding means for preventing relative lateral displacement of the handle shanks when the handles are together and certain of the work-engaging elements are employed.

Matsler, U.S. Pat. No. 1,382,109 describes a wire stretching tool comprising a handle member having an enlarged extension on one end, the extension being disposed in right-angular relation to the handle member, the outer end portion of the extension being reduced to provide a shoulder, the reduced portion tapering from the shoulder to the end of the reduced portion, the end being bifurcated for the reception of one end of a wire, whereby the wire may be wound upon one of the fingers resulting from the bifurcation to prevent slipping.

Mitchell, U.S. Pat. No. 1,495,028 describes a tool having a head formed of two jaws movable toward and from each other and formed with opposed cooperating faces, the outer ends of said jaws being similar and longitudinally curved from said opposed faces thereof and transversely curved from side to side throughout their lengths so that the jaws are of substantially uniform thickness throughout their lengths, the opposed faces of said jaws being oppositely recessed divergingly inward from the outer ends thereof; and said recessed portions extending from side to side of said jaw to form roundedly pointed cutters of substantially the thickness of the jaws, which are continuous throughout the transverse curvature of the outer ends of the respective jaws, whereby each of said jaws is provided with a rugged penetrating point having curved cutting edges.

MacPherson, U.S. Pat. No. 1,532,147 describes a fence tool comprising two similar members recessed intermediate their ends for pivotal union with each other, the one member including a removable staple-pulling element inset on the outer face thereof, a pliers jaw, a hammer head, and a wire cutting edge; the other member including a removable staple-pulling element similarly inset, a pliers jaw, a claw element, and a wire cutting edge, the elements functioning in pairs upon co-action of the two members.

Perrin, U.S. Pat. No. 1,644,352 describes a handle comprising pivotally attached sections, a hammer head on the extremity of one of the pivotal sections, and tapered corrugated extensions on the inner edges of the handle sections commencing at the pivoted joining thereof and extending rearwardly therefrom in registering relation, adapted to grip the end portion of a wire, for firmly holding the same while intermediate portions of said wire are being wound around the hammer head by manipulation of the device, the space between the tapered extensions converging forwardly and terminating substantially at the pivotal point of said handle sections to provide a gripping capacity of increasing magnitude as the wire is drawn forwardly during the winding operation.

Settles, U.S. Pat. No. 1,949,335 describes a pair of crossed pivoted levers, enlarged extensions rigid with the pivoted ends of the levers, the extensions being formed with relative deep opposed V-shaped notches that extend outwardly from the meeting edges thereof and across the entire width of the extensions to form cooperating jaws, the jaws being provided with a single pair of opposed relative deep V-shaped notches adjacent one side of the tool to provide the jaws with cooperating relatively wide pincher portions at one side and relatively narrow elongated staple-extracting portions at the other side having thin straight contacting edges.

Feigion, U.S. Pat. No. 2,313,530 describes a combination tool for connecting the ends of wires in the construction of fences, comprising a pair of pliers for holding an end of the terminal loop of one of the wires, a spindle fixed to and projecting from one of the jaws of the pliers at right angles thereto, and spaced apart circular heads on the spindle with a slot in one of the heads for holding an end of the terminal interengaging loop of the other wire, the spaced apart heads cooperating with the pliers and spindle in twisting the connected terminal loops on each other respectively as the tool is swung around the same with the heads bearing on the wires.

Andrews, U.S. Pat. No. 2,462,250 describes a pair of tongs pivoted together to form a pair of jaws on one side of the pivot and a pair of handles on the other side of the pivot, the jaws having parallel contact faces when the handles are pressed toward one another and having lateral extensions shaped to form a hammer head, one of the jaws having a tooth projecting into the other jaw adjacent to and on one side of the median plane of the head and having a recess adjacent to and on the other side of tile said median plane, and the other jaw having a similar tooth mound opposite the recess and having a recess opposite the first tooth, the teeth being operable for engagement under an embedded staple, and the outer faces of the teeth lying in the end surface of the head while the under faces of the teeth are tapered for exerting outward pull on the staple when the handles pressed toward one another.

De Armond, U.S. Pat. No. 2,501,500 describes a wire-working tool comprising a head, a handle integral with the head, the head providing a shoulder at one side of said handle and having a rounded outer surface opposite said handle and a rounded end surface at one side of said handle, a second handle having a jaw on one end thereof, means pivotally connecting said second handle to said head-attached handle so that said jaw is opposed to said shoulder at the side of said head-attached handle opposite said rounded end surface, whereby a wire may extend along said rounded end surface and said shoulder and be clamped between said shoulder and said jaw and said rounded outer surface may provide a fulcrum for stretching said wire, said rounded end surface having a wire-positioning groove therein and said rounded outer surface, said shoulder and said jaw being serrated.

Fike, U.S. Pat. No. 5,636,398 describes a multiple application hand tool adapted for constructing or repairing wire fences, the tool having a pair of body members interconnected for substantially pivotal movement relative to each other about an axis of reference between a first operational position and a second operational position, the body members individually having head portions engagable with each other in the first operational position to form a substantially unitary hammer head and claw extending substantially in opposite directions from each other on one side of the axis of reference and handle portions deployed on the opposite side of the axis of reference for movement of body members between the first and second operational positions and individually having grasping surfaces deployed for grasping engagement with a wire for tensioning of the wire using the handle portions.

Hay, U.S. Pat. No. 6,314,599 describes a staple pulling plier of the type consisting of a pair of pivoting members having handles and jaws forming a head portion. The head portion has opposite side faces, and the jaws in a closed position define a substantially continuous post engaging top ridge. Pincer points are provided on the jaws adjacent the top ridge and are moved to a closed staple grasping position on closure of the handles. A fulcrum member is formed integrally with the head portion and projects from one of the opposite side faces of the head portion, the fulcrum member defining an upper edge extending in a plane substantially normal to the post engaging top ridge of the jaws. When the bight of a staple is held by the pincer points, the two legs of the staple and the joining bight are in a plane normal to the post engaging top edge of the head portion. When the staple has been driven into a post to secure a horizontal strand of the fence, its plane is usually vertically disposed. Thus, as the plier is swung in a direction coinciding with the plane of the staple, the upper edge of the fulcrum member engages the post, and pressure can be applied in an up or down direction to more effectively withdraw the staple.

The prior art teaches pliers of a wide variety with many features adapted for specific purposes including: hammer surfaces and heft, claws, gripping jaws, crushing jaws, fence wire twisting features, staple and nail pullers, wire stretching features, cutting surfaces. Although both Perrin and Mitchell teach distal and proximal gripping jaws and rounded heads in both transverse and lateral directions, the prior art does not teach, specifically, an elliptical surface formed in the transverse direction in combination with axial gripping teeth, and tongue and groove opposing axially oriented surfaces. Such a combination has been found to provide a greatly superior nail-pulling tool. The present invention fulfills these needs and provides further related advantages as described in the following summary.

SUMMARY OF THE INVENTION

The present invention teaches certain benefits in construction and use which give rise to the objectives described below.

A nail-pulling tool has a two-piece proximal handle pivotally joined with a two-piece distal jaw by a pivoting means. The distal jaw is operated like a standard hand tool with compression of the handle causing the jaw to close, and vice-versa. The distal jaw has an elliptical surface so that with the distal jaw resting on a work surface and closed about a nail protruding from the work surface, and with the handle laying adjacent the work surface, raising the handle away from the work surface in an arc, causes the nail to be pulled from the work surface at an ever increasing rate. Axially oriented jaw teeth provide improved gripping and a pair of tongue and groove opposing surfaces enable cutting and further improved gripping. A hammer surface enables driving of a nail into the work surface rather than pulling it out, and a claw element enables pulling a nail head up so as to be better gripped by the tool. The tool is ideally designed for pulling a bent nail partially upward, straightening it, and then hammering it back into the surface in a more correct and improved manner for accomplishing its fastening task.

A primary objective of the present invention is to provide an apparatus and method of use of such apparatus that provides advantages not taught by the prior art.

Another objective is to provide such an invention capable of pulling a nail from a surface with maximum leverage at the start of removal, and maximum pulling speed as the nail leaves the surface.

A further objective is to provide such an invention capable of improved gripping of a nail.

A still further objective is to provide such an invention capable of cutting a nail with improved cutting force.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
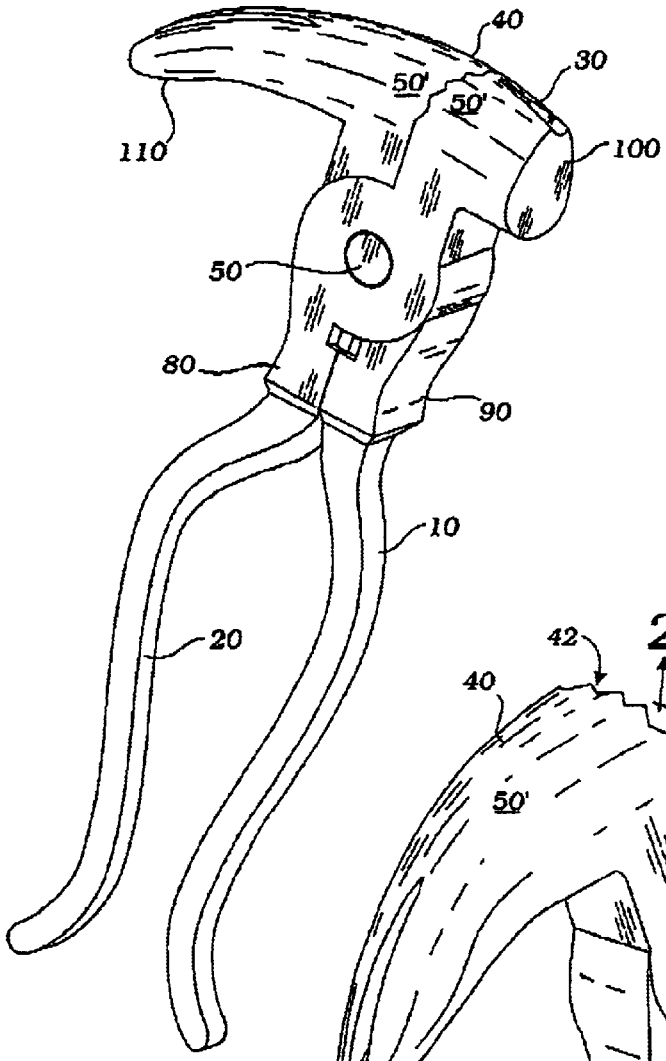
FIG. 1 is a perspective view of the preferred embodiment of the invention showing a set of jaws thereof in a closed attitude.
Figure 2A:
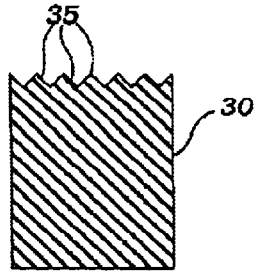
FIG. 2A is a sectional view taken along line 2A—2A in FIG. 2.
Figure 2:
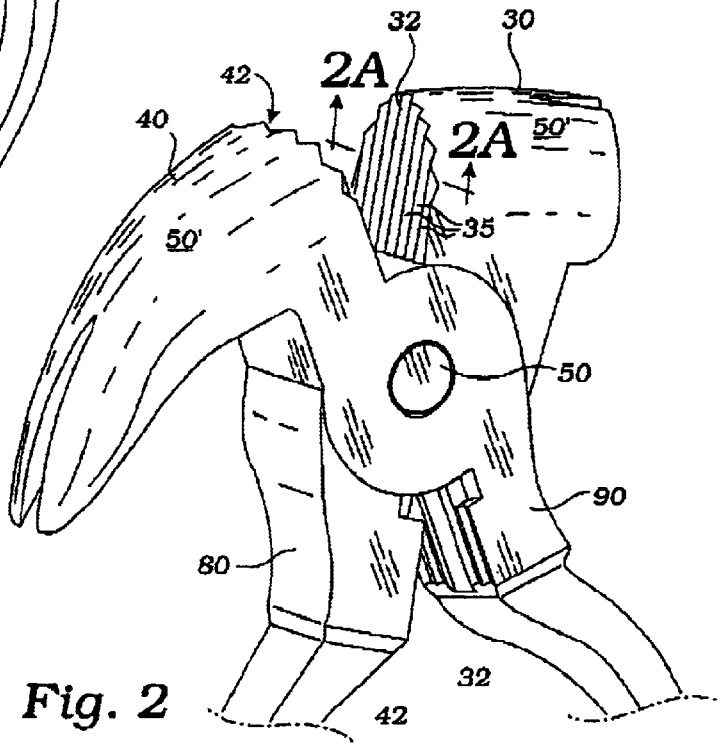
FIG. 2 is an enlarged partial view thereof showing the set of jaws in an open attitude.
Figure 3:
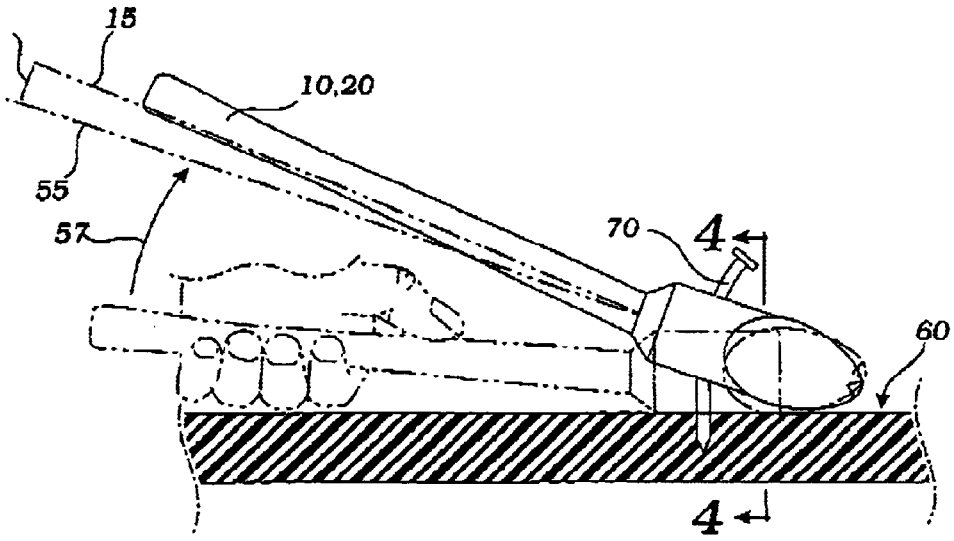
FIG. 3 is a side elevational view thereof showing the manner of use of the tool.

The invention is a nail pulling apparatus or tool comprising a two-piece proximal handle having portions 10 and 20 pivotally joined with a two-piece distal jaw 30 and 40 by a pivoting means 50 such as a pivot pin, as shown in FIGS. 1 and 2. As shown in FIG. 2. what is meant by having the handle pivotally joined to the jaw is that each one of the two-piece handle is pivoted to one of the two piece jaw that is integral with the opposing handle. The distal jaw 30, 40 moves between a closed attitude, shown in FIG. 1, when the handle 10, 20 is in a tightened or closed state, and an open attitude when the handle 10, 20 is in a spread-apart state (FIG. 2). The distal jaw 30, 40 provides an arcuate terminal surface 50' which, as shown by surfaced 100, has an elliptical cross section. By this means the apparatus is enabled, such that with the distal jaw 30, 40 resting on a work surface 60 (FIG. 3), and closed about a nail 70 that is protruding from the work surface 60 (FIGS. 3 and 4), and with the handle 10, 20 laying adjacent, i.e., approximately parallel to the work surface 60 (shown in phantom line in FIG. 3), by raising the handle 10, 20 away from the work surface 60 in an arc 57, as shown in FIG. 3, the nail 70 leaves the work surface at an ever increasing rate. This is an improvement over the current state of the art, since most nails 70 may be removed in a single upward pull, while standard tools usually require at least one further regripping of the nail 70 to fully remove it, i.e., two separate pulls. By reducing the amount of work by 50%, a workman can accomplish almost twice as much work with the same effort. Further, since leverage is maximized at the start of a nail pull, less effort is required to start a stubborn nail, and since maximum speed of removal is provided just prior to the nail leaving the work surface, the nail is removed quicker, saving further work time. The present invention saves both time and effort.

The distal jaw 30, 40 is useful for removal of a nail that is not deeply placed in the work surface, or for a shorter nail. In this case the distance from the elliptical surface to the gripped nail is relatively small and the linear travel for removing the nail is likewise small.

Figure 4:
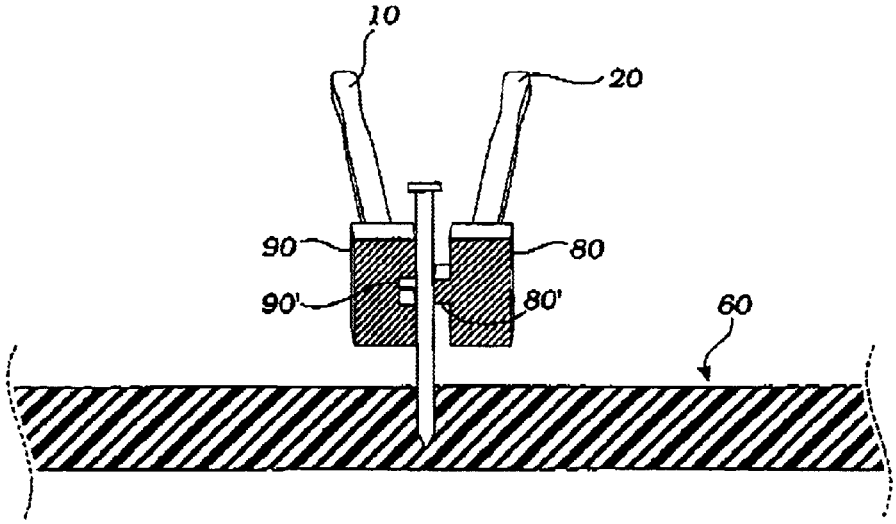
FIG. 4 is a sectional view taken along line 4—4 in FIG. 3.

A second, proximal jaw 80, 90 preferably is contiguous with the handle 10, 20 arid is adjacent to the pivoting means 50. This is clearly shown in FIG. 2. This setup is useful for removal of a nail 70 that is more deeply placed in the work surface 60, or for a longer nail 70. In this case the distance from the arcuate surface 50' to the gripped nail 70 is relatively larger, and the linear travel for removing the nail 70 is correspondingly greater. FIGS. 3 and 4 show a nail 70 being gripped by the proximal jaw and removed from the work surface 60.

The distal jaw 30, 40 preferably provides a hammer surface 100 on one portion 30 of the two-piece distal jaw, and a claw, gripping means 110, on the other portion 40 of the distal jaw.

The distal jaw 30, 40 and the proximal jaw 80, 90 each preferably provides opposing gripping surfaces 32, 42 having axially aligned intermeshing teeth 35.

The proximal jaw 80, 90 additionally provides axially aligned, tongue-in-groove, opposing gripping and cutting surfaces 80', 90', as best seen in FIG. 4.

A longitudinal axis 55 of the distal 30, 40 and proximal 80, 90 jaws is offset from a longitudinal axis 15 of the handle 10, 20 as is clearly shown in FIG. 3 by an angle $\alpha$ which may be in the range of between 15 and 30 angular degrees. This permits gripping the nail 70 when the axis 55 of the distal and proximal jaws is approximately parallel with the work surface (shown in phantom line), and the handle 10, 20 is at the angle $\alpha$ with the work surface 60 thereby enabling clearance for the fingers of the hand gripping the handle 10, 20 as shown in FIGS. 3 and 4.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A nail pulling apparatus comprising: a two-piece handle joined pivotally, the two-piece handle formed integrally with a two-piece jaw, the jaw adapted by a pivoting means for gripping a nail; the jaw formed so as to provide an outer arcuate surface of an elliptical cross-section of the jaw, the outer arcuate surface of the jaw enabling the pulling of the nail from a work surface at an ever increasing rate as the handle is moved between an adjacent and a raised position relative to the work surface.

2. The apparatus of claim 1 wherein the jaw provides a hammer surface on one piece of the two-piece jaw.

3. The apparatus of claim 2 wherein the jaw provides a claw gripping means on another piece of the two-piece jaw.

4. The apparatus of claim 1 wherein the jaw provides tongue-in-groove, opposing gripping and cutting surfaces.

5. The apparatus of claim 1 wherein the distal jaw provides opposing gripping surfaces having intermeshing teeth running longitudinally.

* * * * *